United States Patent [19]

Herzfeld et al.

[11] Patent Number: 4,863,302

[45] Date of Patent: Sep. 5, 1989

[54] SPRAY-BRUSH

[75] Inventors: Ronald Herzfeld, Germering; Karl Wydra, Oberhaindlfing; Herbert Grebe, Erntebruck; Fritz Dickel; Ronald Dickel, both of Bad Berleburg-Berghausen; Norbert Dickel, Troisdorft-Sieglar, all of Fed. Rep. of Germany

[73] Assignee: Thorwarth & Grebe OHG, Erndte Brock, Fed. Rep. of Germany

[21] Appl. No.: 145,744

[22] Filed: Jan. 19, 1988

Related U.S. Application Data

[63] Continuation of Ser. No. 678,345, Nov. 30, 1984, abandoned.

[30] Foreign Application Priority Data

Mar. 31, 1983 [DE] Fed. Rep. of Germany ..... 3311974
Jan. 12, 1984 [DE] Fed. Rep. of Germany ..... 3400934
Mar. 20, 1984 [DE] Fed. Rep. of Germany ..... 3410209

[51] Int. Cl.[4] ..... A46B 11/02; A46B 11/06

[52] U.S. Cl. ..... 401/289; 401/280; 401/286; 401/288; 401/290; 251/323

[58] Field of Search ..... 401/290, 43, 284, 286, 401/288, 289, 291, 269, 278, 279, 270, 280; 251/323, 332, 334

[56] References Cited

U.S. PATENT DOCUMENTS

| | | | |
|---|---|---|---|
| 1,028,011 | 9/1911 | Ferenczy | 401/270 |
| 1,466,119 | 8/1923 | Claflin . | |
| 1,466,474 | 8/1923 | Hatcher et al. . | |
| 1,701,030 | 2/1929 | Collins | 401/286 X |
| 2,303,667 | 12/1942 | Taborski . | |
| 2,341,881 | 2/1944 | Rasch | 401/278 |
| 2,638,614 | 5/1953 | Anderson | 401/280 |
| 2,813,529 | 11/1957 | Ikse | 401/279 X |
| 3,593,707 | 7/1971 | Pifer . | |
| 3,682,176 | 8/1972 | Kelsen . | |
| 3,738,761 | 6/1973 | Segerstad | 401/290 |
| 4,249,757 | 2/1981 | Gella | 281/15 R |
| 4,407,527 | 11/1975 | Kelsen . | |
| 4,537,576 | 8/1985 | Thorsheim et al. | 446/147 |

FOREIGN PATENT DOCUMENTS

| | | | |
|---|---|---|---|
| 1457057 | 10/1965 | Fed. Rep. of Germany | 401/270 |
| 1491006 | 1/1970 | Fed. Rep. of Germany . | |
| 2021146 | 11/1971 | Fed. Rep. of Germany . | |
| 3111063 | 10/1982 | Fed. Rep. of Germany | 401/289 |
| 1478125 | 4/1967 | France . | |
| 2380011 | 9/1978 | France . | |
| 506349 | 12/1954 | Italy | 401/43 |

*Primary Examiner*—Steven A. Bratlie
*Attorney, Agent, or Firm*—Griffin Branigan & Butler

[57] ABSTRACT

A spray arrangement, particularly a brush-like body-cleaning and/or massage device, particularly a toothbrush (1) with at least a nozzle body (10') may be coupled to a hollow handle which is connectable by a hose to a water faucet. Nozzle body (10') is preferably a fluidic oscillator without moving parts. The hollow handle may receive into a metering cartridge a rod of a slow-to-dissolve active substance. The handle is provided with a removable elongated cap whose forward end may be coupled securely irrotationally with tube (5) of the cleaning brush. Moreover, the cap includes a manually actuatable water valve which is manually displaceable into the open position against a spring force and/or opposing water pressure. The water valve is preferably formed as a multi-step slide valve piston (68) with a conical shut-off member (72). Bristles (4) of the body cleaning device are preferably arranged on a bristle plate (3) which is held by snap-fastening means on a bristle carrier part (2) in easily exchangeable manner, whereby bristle plate (3) and bristle carrier part (2) in combination with tube (5) and a tunnel-like recess for receiving the nozzle body (10') form, for example, the toothbrush (1).

2 Claims, 5 Drawing Sheets

Figure 1:
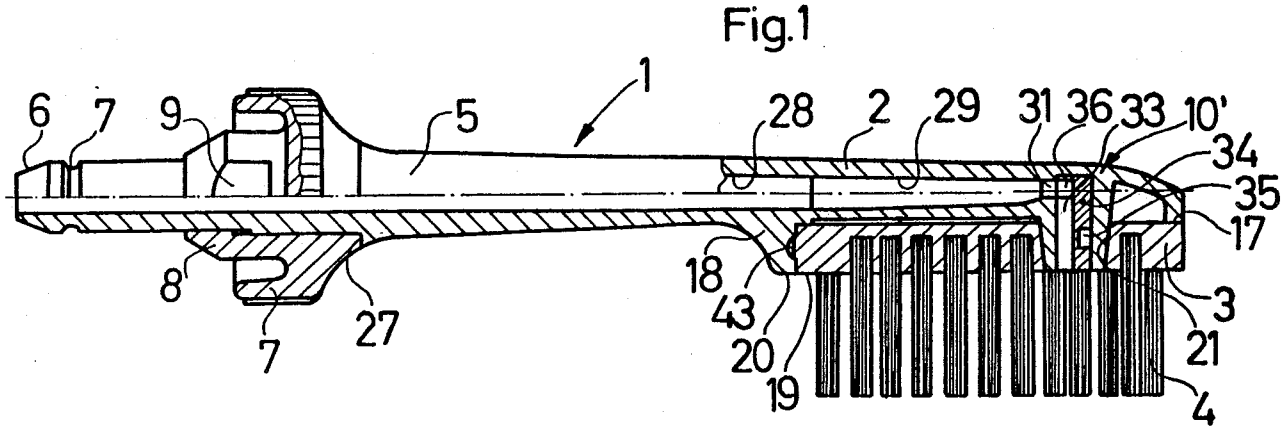

Fig.6
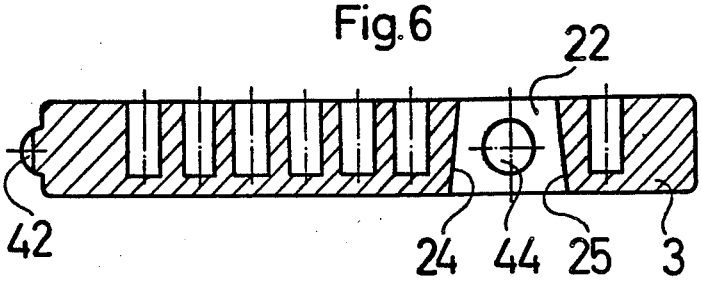
Fig.7
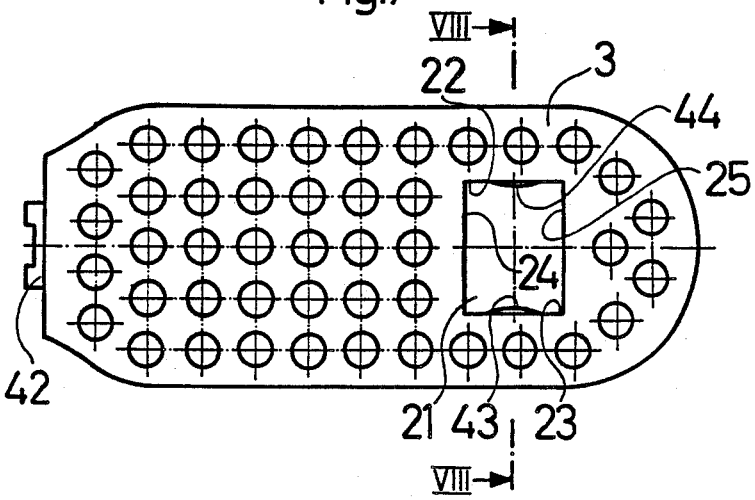
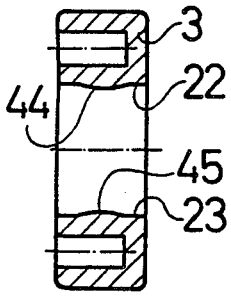
Fig.8

SPRAY-BRUSH

This is a continuation of application Ser. No. 678,345, filed Nov. 30, 1984, now abandoned.

The invention relates to a spray arrangement, particularly a brush-like body-cleaning and/or massage device (toothbrush), with at least one spray nozzle and with a handle through which passes a channel and which is connectable to a pressurized water source (water faucet). Toothbrushes are understood to include also denture cleaning brushes. The invention also includes body-care and body-cleaning devices which are connectable to a water faucet, such as for example face cleaning brushes. The cleaning brush contains at least one nozzle for issuing a spray stream which augments or promotes the body-care or cleaning action. The brush is integrated with or coupleable to the handle which is fixedly connected to a water hose at its one end. The water hose terminates in a coupling plug which is connectable to a water faucet via a known adapter. Nozzle elements are known in form of fluidic oscillators which do not contain any moving parts and which, on the basis of their special oscillator configuration, issue a quickly back-and-forth sweeping spray stream which exhibits special cleaning and/or massaging effects and which, therefore, is particularly advantageous in body-care and body-cleaning devices. Oral Irrigators with such fluidic oscillators are already known, for instance by the West German DE-PS 25 05 605. An adaptor is known by publication DE-OS 26 34 721.

It is, therefore, an object of the invention to also provide an easily mass-produceable spray arrangement of the above-named kind which contains at least one spray nozzle and whose handle exhibits a water shut-off which interrupts the water connection to the oscillator as long as it is not actuated. In its inactive position, the water shut-off valve should safely close off water flow in spite of differing water pressures, above all in pressure ranges experienced by faucets of households, particularly in bathrooms. The water shut-off valve should automatically return to its closed position subsequent to substantially light manual actuation.

A further object of the invention is to provide a spray arrangement, particularly in form of a toothbrush or a denture cleaning brush, constructed in such a way that the bristles are replaceable by the user in simple and comfortable manner by new or different bristles without special aids. In this way renewal, especially of a toothbrush, requires only exchange of bristles with new or different bristles without need for renewal replacement of the actual brush holder with at least a fluidic oscillator and the handle, which parts experience substantially lesser wear than the bristles.

The invention solves the above tasks with the characteristics of the claims and/or with the following description of preferred embodiments. Herein is depicted in a drawing a toothbrush in accordance with the invention in combination with a handle. The invention is not limited to such a toothbrush with handle. On the basis of the claims and/or in connection with the presented and described embodiment, alternatives which lie within the framework of the invention are offered to someone knowledgeable in the art. Thus the characteristics according to the invention for the toothbrush handle are easily transferable, for example, to a handle for a face cleaning device, wherein the brush with the nozzle and the handle form an apparatus of unitary construction.

Figure 5:
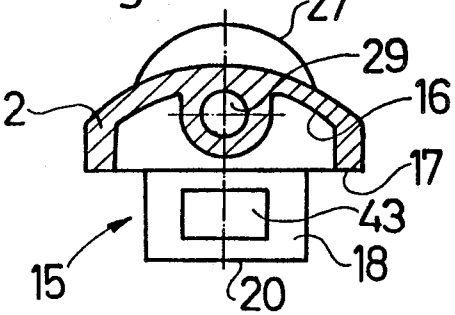
Figure 4:
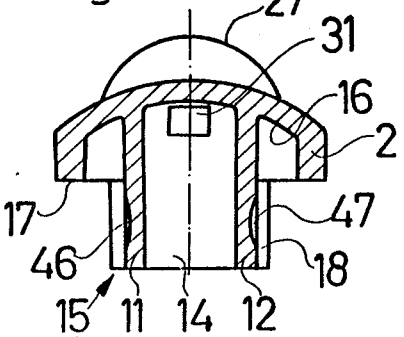
Figure 2:
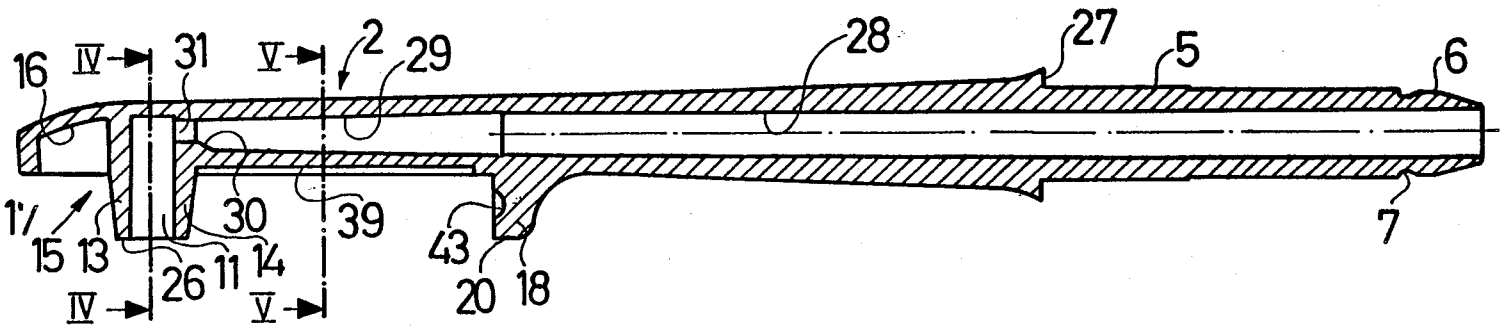
Figure 3:
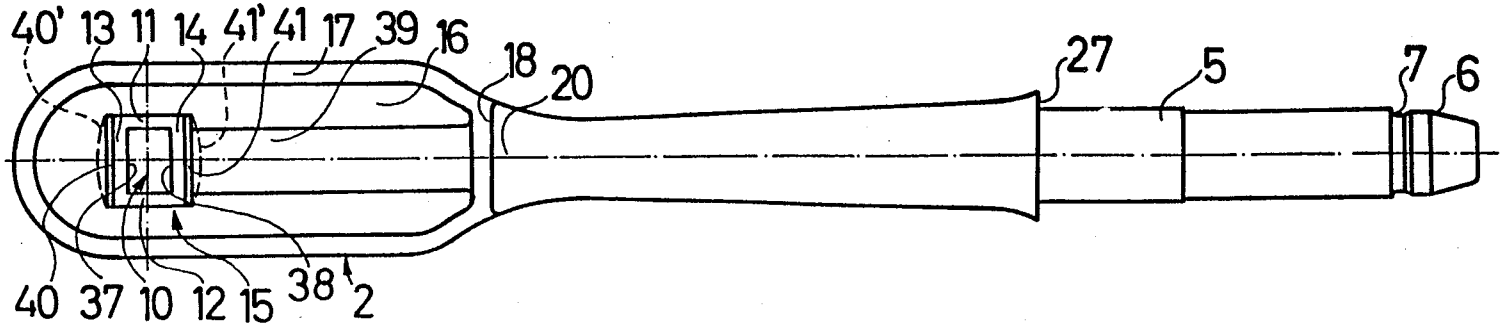
Figure 9:
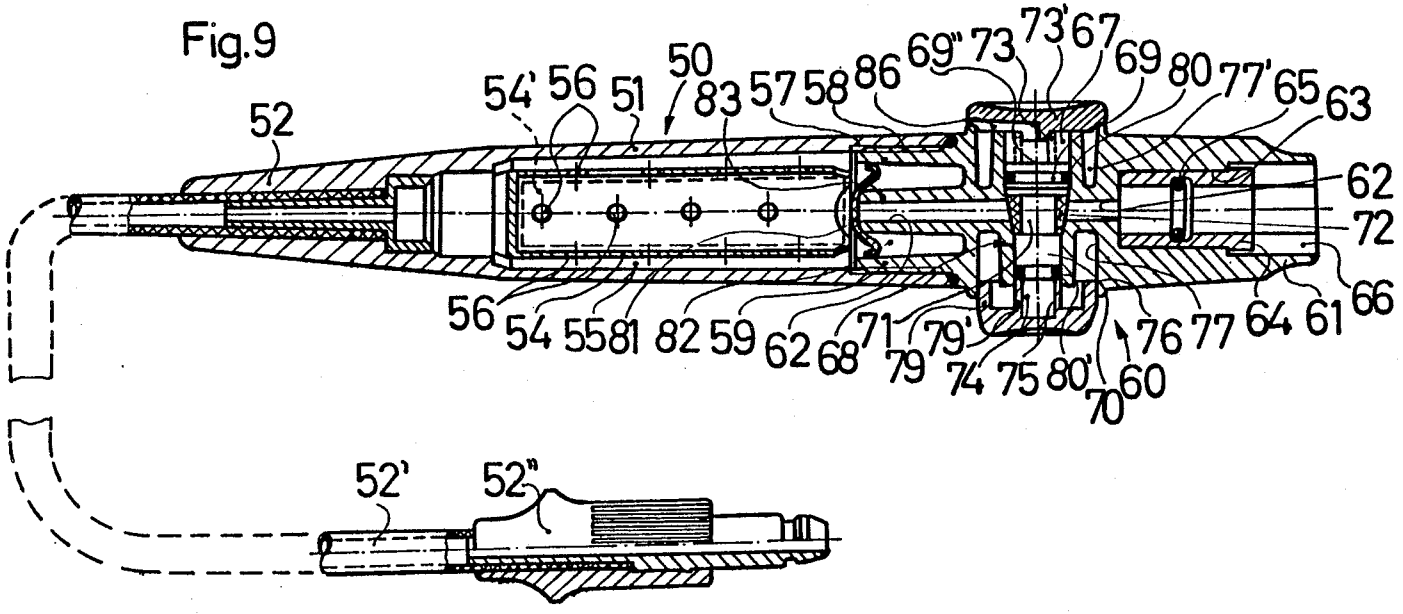
Figure 10:
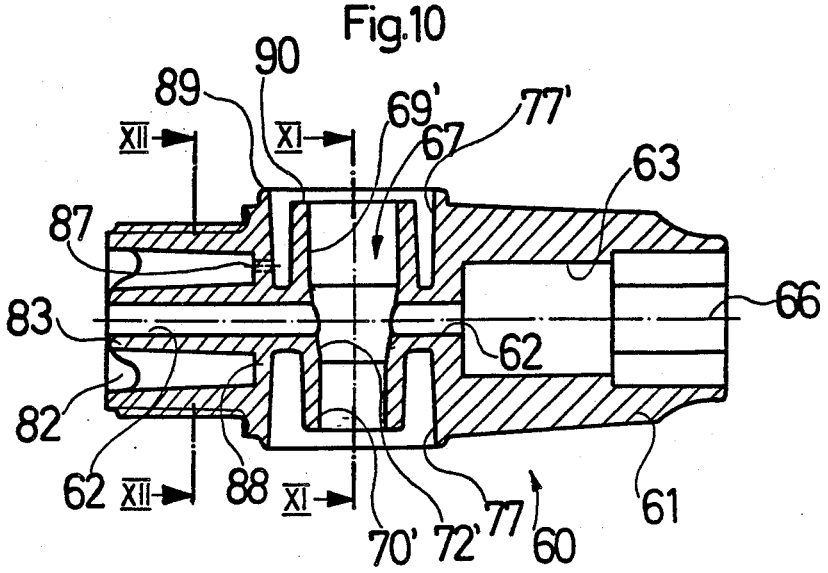
Figure 11:
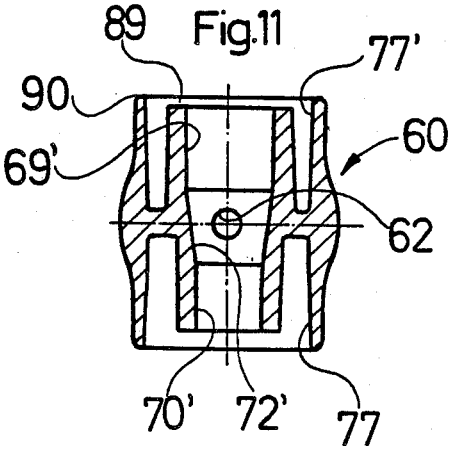

In enlarged representation the drawing shows in:

FIG. 1 a partial longitudinal section through a toothbrush in accordance with the invention, consisting of a bristle carrier part and an exchangable bristle plate;

FIG. 2 a longitudinal section through the bristle carrier part according to FIG. 1 without the bristle plate;

FIG. 3 a plan view of the bristle carrier part according to FIG. 2;

FIG. 4 a cross-section IV—IV in FIG. 2;

FIG. 5 a cross-section V—V in FIG. 2;

FIG. 6 a longitudinal section through the bristle plate according to FIG. 1 without bristles;

FIG. 7 a plan view of the bristle plate according to FIG. 6;

FIG. 8 a sectional view VIII—VIII of FIG. 7;

FIG. 9 a longitudinal section through a toothbrush handle according to the invention in connection with a hose and a coupling connector on the hose, whereby the hose is only shown in portions;

FIG. 10 a longitudinal section through an enlarged portion of the handle shown in FIG. 9, which includes a further embodiment of the handle according to the invention;

FIG. 11 a section XI—XI of FIG. 10; and

Figure 12:
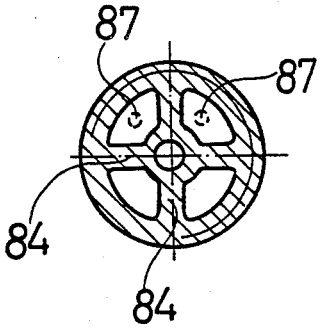

FIG. 12 a section XII—XII in FIG. 11.

Identical parts are referred to with the same reference numerals in the Figures.

FIG. 1 shows a partial longitudinal section through toothbrush 1 according to the invention, comprising a bristle carrier part 2 and an exchangeable bristle plate 3 with bundles of bristles 4 incorporated in it in conventional manner. Bristle carrier 2 is of unitary construction with a short tube 5 whose coupling end 5 is connectable with the handle shown in FIG. 9. For this purpose, coupling end 5 is provided with a groove 7 which engages a yet to be described coupling ring in the handle, which is described in further detail below. A ring body 7 is fastened onto coupling end 6 to facilitate insertion of the toothbrush 1 into the handle and extraction of the toothbrush 1 from the handle. In order to secure the coupling of toothbrush 1 with the handle against rotation, ring body 7 possesses a cylindrical internal ring section 8 exhibiting two flattened coupling faces 9 on opposite sides, of which only one side is visible in FIG. 1. These faces, in combination with corresponding mating faces in the furtherbelow described handle serve to secure the toothbrush against rotation.

The bristle carrier part 2 has in its forward region a tunnel-like recess 10 of rectangular inner cross-section for insertion of a nozzle body 10'. The opening 10 is bordered by longitudinal walls 11 and 12 in parallel with the longitudinal axis of the bristle carrier part 2, and by mutually parallel transverse walls 13 and 14. Walls 11 to 14 form a tower-like protrusion 15 integral with the half-shell-shaped floor 16 of the bristle carrier part 2. Protrusion 15 extends from floor 16 vertically upward essentially above the surrounding flat rim 17.

The bristle carrier part 2 possesses at its rear end a shoulder 18 protruding vertically upward above rim 17. Shoulder 18 supports the rear end of the bristle plate 3. The front face 19 of bristle plate 3 lies substantially flush with the outer face 20 of shoulder 18.

Bristle plate 3 possesses in its front region a rectangular cutout 21 which is bordered by longitudinal sides 22, 23 in parallel to the longitudinal axis of bristle plate 3 and by parallel transversal sides 24, 25. Bristle plate 3 engages the tower-like protrusion 15. Outer faces 26 of the protrusion are substantially flush in the same plane with the front side 19 of bristle plate 3.

The bristle carrier part 2 according to FIG. 1 is depicted by itself in a longitudinal sectional view in FIG. 2. The sectional view of FIG. 2 is shown somewhat enlarged in relation to the sectional view in FIG. 1. Additionally, ring body 7 is distant from the coupling end 7 of tube 5 on the bristle carrier part 2. In this manner it is made clear that ring body 7 is supported on annular shoulder 27.

The wall of tube 5 encloses a first cylindrical channel section 28 which extends approximately into the region of shoulder 18 of the bristle carrier part 2. A further channel section 29, which contracts conically in direction toward cavity 10, connects to channel section 28. Channel section 29 is narrowed down by an inclined face 30 and thereafter connects to a relatively short channel section 31 which has a rectangular cross-section and which enters into the tunnel-like cavity 10. The rectangular channel section 31, as shown in FIG. 4, is of importance to the fluid-dynamics of the operation of the nozzle body 10' which is fixedly inserted into cavity 10 as shown by FIG. 1.

Advantageously, this is an as yet unpublished fluidic oscillator, which has been described in a patent application filed by Peter Bauer under the title "High-Flow Oscillator" in the U.S. Patent Office on January 11, 1984, which is distinguished by its particularly short axial construction length despite a high flow rate, and which is substantially shorter than the fluidic oscillator with a similar channel configuration known from the international application PCT/US 80/00231.

The especially short constructional length of the High-Flow Oscillator of January 11, 1984 is substantially achieved by that the main nozzle with the connected interaction chamber and the outlet opening of the oscillator configuration consist of first recesses 33 in one function side of the rectangular oscillator body 34 and by that the feedback channel consists of a second channel-like recess 35 in the other oppositely located function side of the oscillator body 34 and that the channel-like recess 35 is connected to the recesses 33 via bores, resp. openings (not shown here) which penetrate through body 34.

The nozzle body 10' is inserted into the cavity 10 of the tower-like protrusion 15 in such a manner that a substantially rectangular inlet section 36, located upstream from the main nozzle, is positioned exactly opposite the rectangular outlet opening of the channel section 31.

The rectangular cross-section of channel section 31 is advantageously particularly adapted in size to the rectangular cross-section of the inlet section 36, whereby it is notable that the border edges of inlet section 36 do not protrude substantially into the outlet opening of channel section 31. In order to achieve as low as possible an overall height of toothbrush 1, the tower-like protrusion 15 with the nozzle body 10' may protrude beyond the front face 15 of brush plate 3. In that case it is appropriate to round off the protruding outside edges on the front face 26 of protrusion 12.

Inside dimensions of the tunnel-like cavity 10 and outside dimensions of nozzle body 10' are chosen such that the oppositely lying function sides with their recesses 33 and 35 on both sides each seal area-tight onto inner sides 37 and 38 of transverse walls 13 and 14 of the tower-like protrusion 15. Above all, transverse walls 13, 14 of protrusion 15, which are subjected to pressure, must have a minimal strength, which may also be achieved by constructing the transverse walls with convex outer sides in deviation from the depiction of FIG. 3, as however indicated by broken lines 40' and 41'. An area-tight seal joint of nozzle body 10' with its both oppositely lying parallel function sides onto the parallel inner sides 37 and 38 of transverse walls 13, 14 is achieved by that the function sides contact the inner sides 37 and 38 with a certain preloading. Here it is important that both function sides of nozzle body 10' as well as the inner sides 37, 38 of the transverse walls 13, 14 are mutually parlalle and that they exhibit very smooth surfaces.

FIGS. 3, 4, and 5 clarify the half-shell shape of the bristle carrier part 2. The bristle plate 3 supports itself on its peripheral flat rim 17. The tower-like protrusion 15 is connected to a tunnel-like tubular jacket 39 which encloses the conical channel section 29 (FIG. 2).

FIGS. 1 to 3 show that the outer sides 40, 41 of transversal walls 13 and 14 are angled such that the thicknesses of the transversal walls 13 and 14 increase in direction toward the floor of cavity 10. Correspondingly, oppositely lying transverse sides 24 and 25 of cutout 21 in bristle plate 3 are angled with respect to each other, as shown in FIGS. 1 and 6. Transverse and longitudinal sides 22, 23 and 24, 25 contact outer sides of walls 11, 12 and 13, 14 of protrusion 15 substantially without play.

To facilitate replacement of the bristle plate 3 on the bristle carrier part 2, a half-round protrusion 42 is located on the rear end of bristle plate 3. Protrusion 42 forms a hinge joint as it indexes in a corresponding half-round recess 43 which provides the bearing for the joint. Protrusions 44, 45, which elastically snap into corresponding dimples 46, 47 in the parallel outer sides of the longitudinal walls, 11, 12 of the tower-like protrusion 15, are located on the parallel longitudinal sides 22 and 23 for the purpose of clamping of bristle plate 3 onto bristle carrier part 2.

In order to exchange a bristle plate 3 on a bristle carrier part 2, a thin knife-like object is pressed into the gap on the front face of the toothbrush between bristle carrier part 2 and bristle plate 3, whereby the protrusions 44, 45 on the longitudinal sides 22, 23 of the cutout 21 jump out of the dimples 46, 47. The bristle plate 3 pivots about bearing 43 in shoulder 18 until the tower-like protrusion 15 clears the bristle plate 3. Bristle plate 3 is thusly held, on one hand, by the hinge joint 42 which engages bearing 43 and, on the other hand, by protrusions 44, 45 on the bristle plate engaging into dimples 46, 47 in the manner of a snap-connection.

To obtain a substantially sealed joint of the bristle plate 3 to the hollow inner region of the half-shell-shaped bristle carrier part 2, the surounding rim 17 may be provided with a groove into which a protruding ridge on the rear face of the bristle plate 3 engages or vice versa.

The distance of the bearing 43 from the tower-like protrusion 15 of the bristle carrier part 2, respectively the distance of the hinge joint 42 from the cutout 21 in bristle plate 3 establish the sweep radius with which cutout 21 sweeps over protrusion 15 when the bristle plate is pressed onto the bristle carrier part 2.

Thus angles of the angled outer sides 40, 41 of transverse walls 13, 14 of protrusion 15 and of the correspondingly angled transverse sides 24, 25 of cutout 21 of the bristle plate 3 are established such that outer sides 40, 41 adjoin the transverse sides 24, 25 substantially without play.

In FIGS. 9 to 11 the handle 50 in accordance with the invention is shown to consist of a long tublular body 51 to which tubing 52' is connected at its rear end 52, whose free end is connected with a coupling plug 52" for coupling via a known adapter to the water faucet. Such an adapter is shown in DE-OS 26 34 721. The hollow inner region 53 of tubular body 51 is formed sufficiently large to receive a perforated metering cartridge 54. The metering cartridge holds a rod 54' of a slow-to-dissolve mouthwash substance which is represented by broken lines. As the water flow passes by in the annular gap 55 between the metering cartridge 54 and the inner wall of the tubular body 5, the rod of mouthwash 54' is slowly dissolved, such that a predetermined amount of solute is continuously added to the by-passing water flow. A similar metering cartridge for hard to dissolve rods of mouthwash substance is known by DE-OS 31 47 264.

At the forward open end of the tubular body 51 of handle 50 is arranged an inside thread 57 into which the outside thread 58 engages at the rear end 59 of an elongated cover or cap 60, which acts as a closure for tubular body 51. Cap 60 together with tubular body 51 form the complete handle 50.

The cap 60 in accordance with the invention is provided with a central channel 62 which connects at the front end of the cap to an enlarged channel 63 which holds a sleeve 64. Sleeve 64 is provided with an inside annular groove 65 to retain an 'o'-ring which engages groove 7 when the tubular end 6 of toothbrush 2 is inserted. In this way toothbrush 1 is connected to cap 60, respectively to handle 50 in a water tight sealed manner. To avoid rotation of toothbrush 1 when inserted in cap 60, the front end of the cylindrical channel enlargement 63 is provided with inwardly raised flat mating faces 66 at radially opposed cylinder wall locations, which lie parallel to each other and only one of which is visible in FIG. 9. In the correct coupling orientation of toothbrush 1 in handle 50, the flat mating faces 66 adjoin the flat mating faces 9 on the ring body 7 of toothbrush 1 with minimal clearance. Between the two ends 59 and 61 of cap 60 is provided an opening 67 which is oriented transversally to the longitudinal axis of the cap and which crosses channel 62. Opening 67 serves to receive a valve-like slider body 68 which consists of two cylindrical sections 69 and 70 which exhibit different diameters. A reduced size center section 71 with a cone ring seal 72 is located between the two cylindrical sections 69 and 70. A spring 73 supports itself on the face 69" of the larger cylindrical section 69 and presses against the inner floor of a cover 73' which closes off opening 67 in relation to the outside.

The extreme end stem 74 of the cylindrical section 70 with the smaller diameter extends somewhat beyond opening 67. The stem 74 of the cylindrical section 70 is fastened in a central hole 75 of a pushbutton 79 which exhibits an outer cylindrical guide section 76 for sliding of the slide body 68. Guide section 76 is guided slidably in an annular recess 77 of cap 60 which is coaxial to opening 67.

Corresponding to the three-part shape of slide body 68, opening 67 exhibits a narrower cylinder wall section 70' to guide the smaller cylinder section 70 and a further cylindrical wall section 69' to guide the further cylinder section 69. Between both cylindrical sections 69' and 70', opening 67 exhibits a conical wall section 72' which crosses the central water connection channel 62 and forms an annular valve seat.

In the shut-off position of slide body 68, cone ring seal 72 is pressed by spring 70 onto the middle cone-shaped wall section 72' and thus the central water connection channel 62 is shut-off toward the toothbrush 1. In this position, the smaller cross-section cylinder section 70 protrudes most from the narrower wall section 70' of opining 67. Pressure onto pushbutton 79 causes slide body 68 to be more or less pushed out of its shut-off position against the force of the spring 73, whereby an annular gap is opened up through which channel 62 is now connected. The stronger the force that acts onto the button during actuation of the slide valve, the wider the annular gap opens up, such that the water flow rate freed via slide body 68, for ex. to the toothbrush depends on the force with which pushbutton 79 is pressed manually against cap 60.

The further and the narrower cylindjer sections 69 and 70 of slide body 68 are provided in a first embodiment according to the invention each with a sealing ring 80, respectively 80'. Sealing ring 80 is positioned in a peripheral annular groove, whilst sealing ring 80' lies between an annular shoulder 74' at the end of the cylinder section 70 and the frontal face of the annular wall 79' which surrounds the central hole 75 of pushbutton 80 and which is enclosed with a small clearance in section 70' of opening 67.

At the rear end 59 of cap 60 is held a cover-like screen 81 which covers the central water channel 62. The surrounding lip of screen 81 is pressed into a central annular recesss 82 at the rear end of cap 60. Screen 81 is supported on the face of the cylindrical wall 83 which surrounds channel 62 and on the ends of two orthogonal radial web walls 84 and 85 which stiffen the central annular recess 82 (FIGS. 10 and 12).

The return of the slide body 68 into its sealing shut-off position is assured alone by the force of spring 73 according to the above described embodiment example. Therefore, spring 73 has to be relatively strong. The cylinder volume, in which the spring is located, is continuously vented via a groove 86 in cover 73'.

In accordance with a modified embodiment of the invention, vent 86 to ambient may be omitted. A flat cover 73' closes off opening 67 fluid-tight with respect to amibient. Instead of that, the outer surface 19' of the larger cylinder section 69 is connected via at least one in dotted lines indicated opening 87 (FIG. 10) in the radial dividing wall 88 between opening 67 and the central annular recess 82 to the tubular body 51 of handle 50, such that slide body 68 is pressurized by water pressure from the handle in shut-off direction. Additionally, sealing ring 80 is omitted.

Spring 73 may be entirely omitted in this case or it may be relatively weak. The only task for spring 73 is to hold the slide body 68 in its shut-off position even during absence of water pressure and when the pushbutton is not actuated.

Depending on the difference between the effective areas of slide body 68 the water pressure exerts a certain closing pressure onto the slide body 68, which ensures that the slide body 68 returns to its shut-off position when the pushbutton 79 is released. The effective area differential between the larger and the smaller piston 69, resp. 70 advantageously augments the opening motion of slide body 69.

Cap 60 as well as tubular body 51 of handle 50 are preferably manufactured from plastic material. For this purpose it is advantageous to provide the above described annular recesses 77 and 82. The radial annular recess 77 extends close to the central water connection channel 62. Additionally, a furthe radial annular recess 77' is provided coaxially to opening 67. The further annular recess 77' is opposed to annular recess 77 and extends also close to the water connection channel 62. In use of the further embodiment of the invention wherein the slide body 68 is preloaded by water pressure in shut-off position, openings 87 in the radial dividing wall 88 interconnect axial annular recess 82 with the radial annular recess 77'. Since in this case the flat cover 73' seals tightly only on the outer rim 89 of annular recess 77', annular recess 77' connects to opening 67 via the set back inner rim 90 (FIG. 10).

It is clear that the invention is not limited to the toothbrush 1 with handle 50. Based on the teachings of the invention, a person skilled in the art is enabled to indicate other brush-like body cleaning or body massaging devices, for example a face cleaning device, in which the handle with a brush and at least a nozzle are intergrated in one apparatus, which in principle exhibits a similar water shut-off as the above described handle 50. In such an arrangement, water shut-off may be preloaded by a spring alone or also augmented by water pressure in direction of shut-off.

It is further clear that the slide body 68 may also be replaced by other kinds of stepped pistons.

Finally, the invention is not limited to brush-like devices for body care. For example, it could also concern shaving brushes, car wash brushes, or other brushes utilized in households, or also any kind of spray arrangements, for instance lawn-sprinklers, which are connectable via a manually actuatable valve in a handle to a source of pressurized water.

I claim:

1. For use in a brush-like body-care cleaning or massage device including at least one spray nozzle for discharge of fluid at the brush-like device, a handle section comprising, in combination:

(a) a channel for passage of said fluid, said channel having an upstream end adapted to be connected to a source of pressurized fluid, and a downstream end;

(b) an upstream tube section forming said upstream end of said channel and secured at one end thereof to a supply hose, the other end of said upstream tube section being releasably coupled to a dowmstream tube section having a valve member and forming said downstream end of said channel and carrying a handle pressure knob at the exterior of said dowmstream tube section for manually operating said valve member, said downstream tube section having an upstream end and further including at a forward end remote from said upstream tube section, coupling means for connecting the handle section to a brush tool;

(c) a first opening transverse to said downstream end of said channel passing through said downstream tube section for receiving said valve member operatively associated with an extension member having one end thereof reaching to and operable from the exterior of the handle at said dowmstream tube section for selectively manually operating the movement of said valve member;

(d) said first opening including a valve seat section of a concavely conical configuration disposed transversely of said downstream end of said channel and crossing it at a point between the upstream and downstream ends of said downstream tube section;

(e) said valve member including an elongated conical stopper section having the surface thereof made from a resilient sealing material, said stopper section having a minor base-end portion and a major base-end portion and being complementary with said valve seat section, said stopper section being integral with a first cylindric valve section and with a second cylindric valve section, said first and said second cylindric valve sections being coaxial with said conical stopper section and being disposed one at each end of said conical stopper section, said first and said second cylindric valve sections being slidably received in a first cylindric channel section and a second cylindric channel section of said first opening, respectively;

(f) the diameter of said second cylindric valve section being uniform and smaller than the diameter of said first cylindric valve section, the diameter of said first cylindric valve section being uniform, one end of said second cylindric valve section being adjacent said minor base portion and the other end being associated, via said extension member, with said handle pressure knob;

(g) said first cylindric valve section being disposed at said major base-end portion of said stopper section and having a front-face portion turned away from said stopper section and disposed within said first cylindric channel section;

(h) a first annular gap formed between siad conical stopper section and said first opening when said valve seat section slides away from said valve seat to open so as to allow fluid pressure from said channel to act on said conical stopper section of said valve member;

(i) a first annular recess formed in said downstream tube section coaxially surrounding said first cylindric channel section, and creating a wall for said first cylindric channel section, said wall having a set back inner rim, said first annular recess being closed with a cover having an inner side so that a second annular gap is created between said inner side of said cover and said setback inner rim and so that said second annular gap is closed fluid tight with respect to ambient;

(j) a coil spring, said coil spring having one end engaged with said front-face portion of said first cylindirc valve section and the other end engaged with said cover, a second opening communicating with said channel for subjecting said front-face portion of said first cylindric valve section to fluid pressure which, in the absence of handle pressure, and, together with said coil spring, urges valve member into a closed position, whereby, in the absence of fluid and handle pressure, said spring urges said valve member into the closed position, and whereby said fluid pressure passing through said first annular gap when said valve member slides away from said valve seat acts on said conical stopper section to augment the movement of said valve member to open from said valve seat;

(k) said extension member having a stem including a peripheral groove for receiving a sealing ring for engaging the wall of said second cylindric channel section, said groove being limited by an annular shoulder of said second cylindric valve section and by a base of a cylindric sleeve fixedly secured to a free-end portion of said stem, said cylindric sleeve being integral with said pressure knob and having a first cylindric outer surface slidably received in said second cylindric channel section which is closed to the exterior with said sealing ring.

2. A device as claimed in claim 1, wherein said pressure knob has a second cylindric outer surface the diameter of which is greater than the diameter of said first cylindric outer surface, said second cylindric outer surface being slidable along a third cylindric outer surface of a second annular recess which is open to the exterior and which is formed in said downstream tube section coaxially surrounding said second cylindric channel section and forming a wall for said second cylindric channel section, said first annular recess having a fourth cylindric outer surface, and wherein the diameters of said third and fourth cylindric outer surfaces are equal.

* * * * *